United States Patent [19]

Murata et al.

[11] Patent Number: 4,683,045

[45] Date of Patent: Jul. 28, 1987

[54] PARTIAL PLATING DEVICE

[75] Inventors: Yasuto Murata; Junichi Tezuka, both of Kanagawa; Kenji Yamamoto, Tokyo, all of Japan

[73] Assignee: Electroplating Engineers of Japan, Limited, Tokyo, Japan

[21] Appl. No.: 924,657

[22] Filed: Oct. 29, 1986

[30] Foreign Application Priority Data

Dec. 16, 1985 [JP] Japan ..... 60-281217

[51] Int. Cl.[4] ..... C25D 17/00

[52] U.S. Cl. ..... 204/206; 204/224 R

[58] Field of Search ..... 204/206, 224 R

[56] References Cited

U.S. PATENT DOCUMENTS 4,163,704 8/1979 Murata ..... 204/206

*Primary Examiner*—T. M. Tufariello

*Attorney, Agent, or Firm*—Flynn, Thiel, Boutell & Tanis

[57] ABSTRACT

This is a plating device for partially electroplating connector terminals at the tip, the target portions to be plated being a pair of forked portions of each connector terminal that are opposing to each other. In this partial plating device, a plating solution supply member to be inserted between the pair of target portions in the connector terminals comprises a support member, anode, net member and winding means. The support member has a top portion substantially forming an arrowhead with slanted guide planes on both sides. An opening is provided at or near the tip of this top portion to allow seepage of the plating solution. The net member covers the top portion of the support at its tip as well as the surface in its vicinity, the net member being freely wound up in the direction intersecting the passage line by the winding means and forming a supply section for the plating solution at a location corresponding to said passage line. With this construction, minute target portions are contacted with the plating solution which seeps on the net member while preventing the net member from being worn at given locations.

4 Claims, 4 Drawing Figures

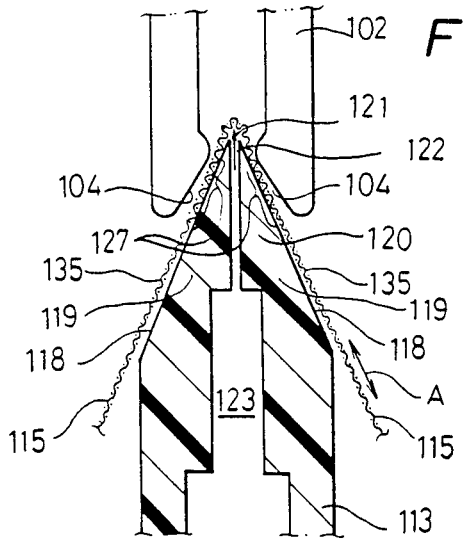
FIG. 3
FIG. 4
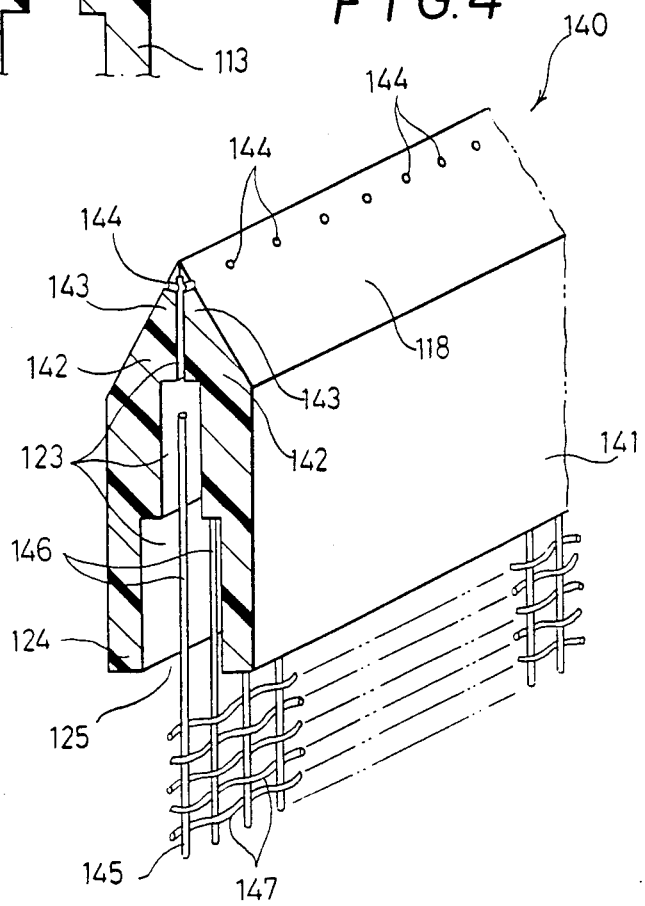

PARTIAL PLATING DEVICE

This invention relates to a plating device, particularly to a device suitable for partially plating a pair of minute portions of a connector terminal opposing to each other.

BACKGROUND OF THE INVENTION

Connector terminals are formed in plural in the form of comb teeth arranged at a given interval on a continuous band-like member. The target portions to be plated in these connector terminals are the sides of the protruding portions extending opposingly across a given interval.

Various techniques have conventionally been employed for plating these target portions. For instance, there have been known as typical plating devices such as the plating device which dips whole end portions including the projections in the plating solution contained in a bath to plate the specified portions by controlling the liquid level of the plating solution, or the injection plating device which shields the portions not to be plated with a mask and plates unmasked portions by jetting the plating solution on them (re. Japanese Patent Application laid-open Nos. Sho 59-126784, Sho 57-161084 and Sho 55-83180).

However, all of the prior art plating devices have drawbacks: in the case of the former device, the entire end portions of a connector terminal are plated resulting in thicker plated areas on peripheral portions than the target portions, and it becomes difficult to clearly define the plating area, thereby consuming unnecessary amount of plating metal. This presents a formidable problem when the plating metal is precious metal.

In the latter injection type device, it is difficult not only to provide the masking but to maintain the same during plating when the target area is very minute or complicated in contour, again resulting in an unnecessary consumption of the plating metal.

Development of a partial plating device has thus been awaited which enables desired plating with less consumption of the plating metal.

BRIEF SUMMARY OF THE INVENTION

The present invention aims to provide a partial plating device which is capable of plating very minute portions of an object at high precision and efficiency to thereby reduce the consumption of precious metal.

These and other objects and features of the present invention will become more apparent from the following description based upon the attached drawings.

BRIEF DESCRIPTION OF THE DRAWINGS

FIG. 3 is a partially enlarged sectional view to show the support member at its top.

FIG. 4 is a schematic perspective enlarged view to explain another embodiment of the support member.

DESCRIPTION OF THE PREFERRED EMBODIMENTS

Figure 1:
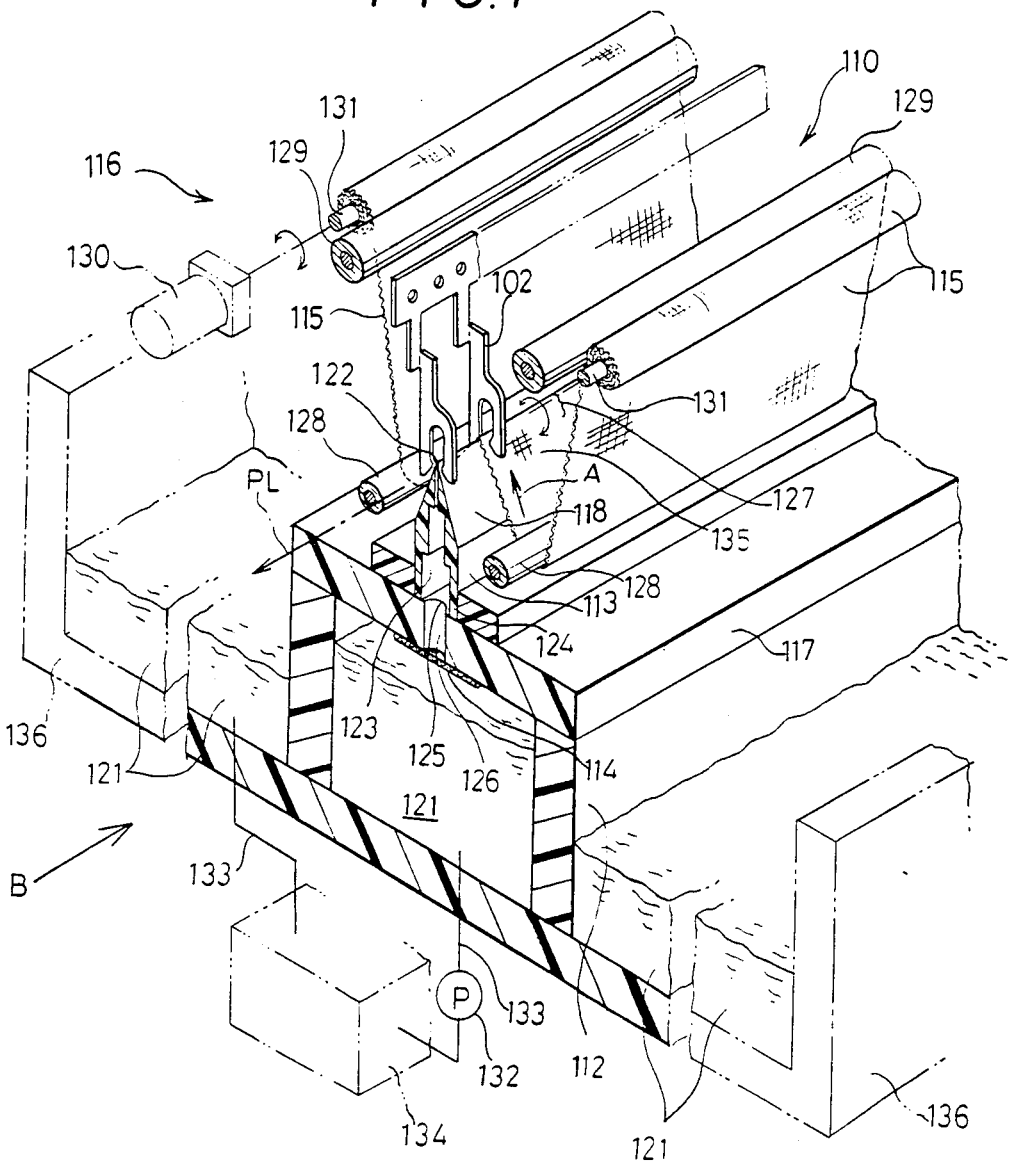
FIG. 1 is a perspective sectional view of the entire plating device according to the invention to show its operations.
Figure 2:
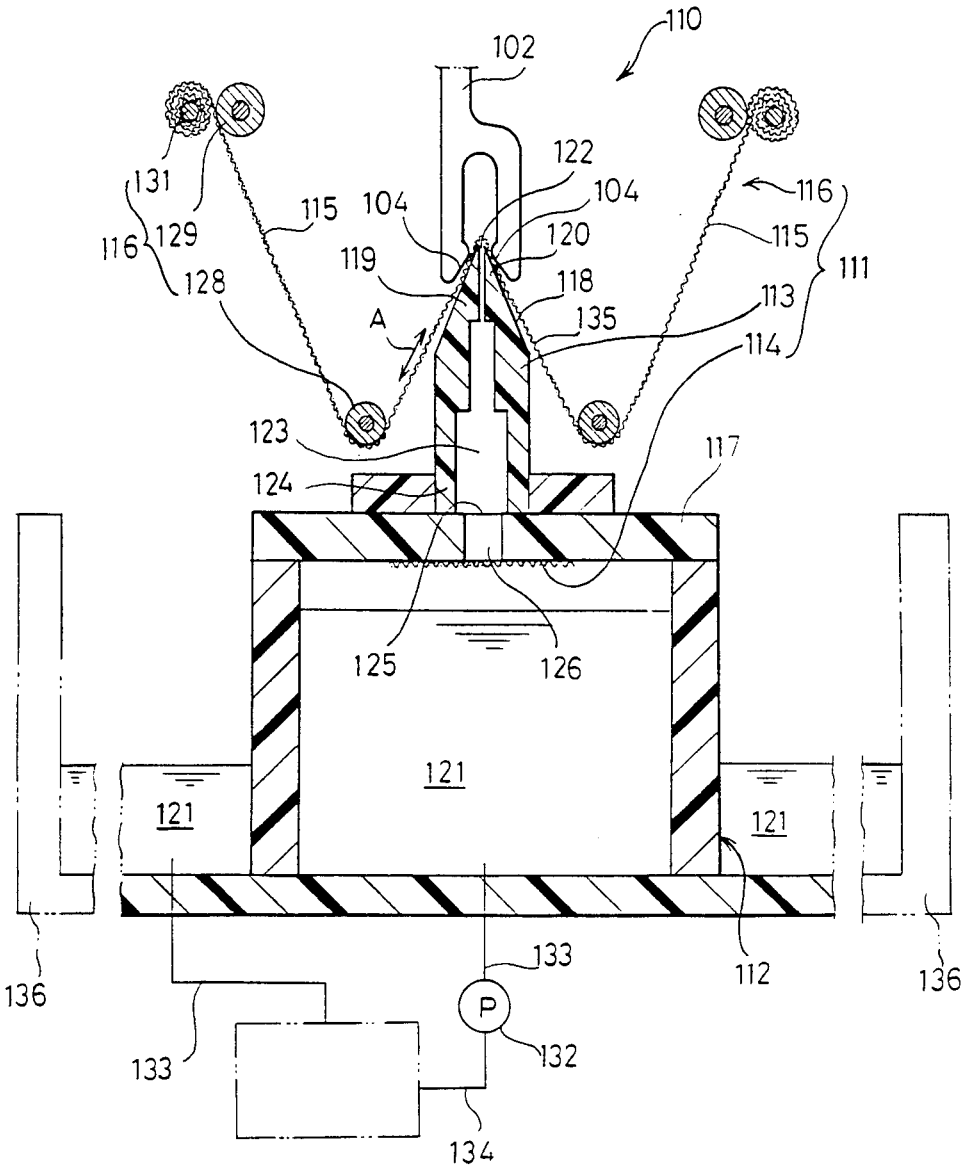
FIG. 2 is a sectional view from the direction indicated by the arrow B in FIG. 1.

First, a plating solution supply member 111 in a plating device 110 comprises a support member 113 mounted and fixed on a plating box 112, an anode 114, a net member 115 and a winding means 116.

The support member 113 is made of an insulating material and mounted and fixed on a cover plate 117 of the plating box 112. The top portion 119 of the support member is substantially in the form of an arrowhead with two slanted sides forming guide planes 118. An opening 122 is provided at the tip 120 of the top portion 119 to allow a plating solution 121 to seep therefrom. A passage 123 for supplying the plating solution communicates with the opening 122 and forms a through-hole within the support member reaching the bottom 124. The passage 123 also communicates with an opening for supply (to be described hereinafter) provided in the plating box 112.

The anode 114 is made of a reticular material so as not to prevent flow of the plating solution 121. The anode 114 is attached to the underside of the cover plate 117 at the opening 126 in the vicinity of the bottom 124 of the support member 113 as well as of an inlet port 125 for supplying the plating solution.

The net member 115 covers the top portion 119 of the support member 113 at the tip 120 and can freely move to be wound in the direction (indicated by the arrow A) which intersects a pass-line (indicated by the arrow PL in the drawings) to form a supply section 127 for the plating solution 121.

The winding means 116 each is provided on either side of said pass-line PL and comprises a guide roller 128 which imparts tension to the net member 115, a rotatable press roller 129 and a drive roller 131 connected to a motor 130 which winds up and pays out the net member 115 in a direction intersecting (indicated by the arrow A) the pass-line PL so that a fresh sheet of the net member 115 is constantly supplied to contact with the plating target portions 104 of a connector terminal 102.

Reference numerals 132, 133, 134 and 136 respectively denote a pump, a pipe, a plating solution controlling tank and a plating bath. These members are used to pump out, recover and recycle the plating solution 121.

The operation of the device will now be described. The connector terminal 102 to be plated is cathodized by a means not shown and moved to a position so that the plating solution supply member 111 can be interposed between the pair of portions 104 to be plated. The plating solution 121 is in the meantime pumped out by the pump 132 to flow through the energized anode 114 and seep out via the supply opening 126, passage 123 and opening 122, where the plating solution is soaked by the net member 115 which covers the opening 122 under tension imparted by the guide roller 128.

Thus the portion of the net member 115 which is disposed at the tip 120 of the top portion 119 and which corresponds to the passage line PL of the target portions 104 is constantly supplied with an optimum amount of fresh plating solution 121, constituting the supply section 127 of the plating solution 121.

The net member 115 is pulled by the roller and is free from so called slackening. The target portions 104 of the connector terminal 102 contact with or approach the net member 115 under tension constituting the supply section 127 and come in contact with the plating solution 121 seeping out the surface 135 of the net member 115, whereby uniform plating can be obtained over the entire area of the target portions 104.

As the plating process completes, the drive roller 131 is rotated by the rotation of the motor 130 to move the net member 115 via the pressing roller 129 in the direction intersecting the passage line PL (the direction of the arrow A) for winding up the net member by a suitable length. This provides the supply section 127 anew. Although the net member 115 is wound up intermittently in accordance with the timing of the plating in this embodiment, it is also possible to continuously wind up the net member 115 during plating to shift the section. In this manner, the net member 115 can be protected against partial wear occurring at a given portion.

FIG. 4 shows another embodiment of the support member. The support member 141 used in the plating device 140 has plural openings 144 along the longitudinal direction of the support member 141 in the vicinity of the tip 143 of the top portion 142 of the support 141. The anode 145 with its lower portion comprising woven warps 146 and wefts 147 and the upper portion warps 146 alone is provided in the passage 123 to function in the same manner as the opening 122 and the anode 114 of the first embodiment.

As the rest of the second embodiment is identical with the first, the description is omitted.

Although the anode is disposed in the vicinity of the inlet port 125 of the passage 123 or erected in the passage 123 in the foregoing embodiments, it is also possible to utilize the support 113 itself as the anode by plating the same with a metal which is insoluble in the plating solution 121.

As has been described, the plating device of the present invention with its features will bring about numerous advantageous effects such as the following:

(a) As the supply section is formed at a position corresponding to the pass-line of the target portions to be plated and where the plating solution is constantly supplied afresh in the optimum amount, the plating solution comes in contact only with the target portions, leaving the remaining portion intact. What is more, as the optimum amount of plating solution is applied via the net member solely to the target portions, plating of unnecessary portions or unnecessary thickness can be avoided, resulting in reduced consumption of the precious metal. When compared with the conventional plating technique in which not only the target portions in the form of fork-like member but the portions near the target portions are also plated, the device of the present invention results in reduction of precious metal consumptin and thus of the cost;

(b) As the net member is wound up by a suitable length in the direction intersecting the pass-line to provide a fresh sheet of the supply section, the net member can be protected against partial wear at a given location; and, (c) The device can be adapted to various applications by modifying the inclination, size and configuration of the support member at its top portion according to the shape and size of the objects to be plated.

What is claimed is:

1. In plating devices for electro-plating minute portions of plural connector terminals, 102 which are formed as a fork each on a continuous band-like member and each of which having a pair of target portions 104 to be plated that are opposing to each other by positioning a plating solution supply section located along the pass-line of the target portions and interposed therebetween and moving the connector terminals in contact with or in the vicinity of the plating solution supply section, a plating device characterized in that said plating solution supply section 111 includes a support member 113 which is shaped substantially like an arrowhead at its top portion 119 with slanted guide planes on both sides, has an opening 122 for allowing the plating solution to seep out at the tip 120 of the top portion and a passage 123 communicating with said opening for supplying the plating solution; an anode 126 which is disposed in or near the passage of the support; a net member 115 which covers the top portion of the support at its tip as well as the surface in the vicinity, can be wound up in the direction intersecting the pass-line and forms a plating solution supply section 127 at a location corresponding to said pass-line; and a winding means 116 which comprises guide rollers 128 for imparting tension to the net member so that the member comes in close contact with the top portion of the support at its tip as well as the surface in the vicinity and drive rollers 131 which wind up and pay out the net member freely.

2. The plating device as claimed in claim 1 wherein the support member 113 is made of a metal which is insoluble in the plating solution and constitutes an anode.

3. The plating device as claimed in claim 1 wherein the support member is provided with plural openings 144 along the longitudinal direction of the support member near its top portion substantially in the form of an arrowhead for allowing the plating solution to seep out.

4. The plating device as claimed in claim 1 or 3 wherein the anode 45 is a net member made of woven warps 146 and wefts 147, with the portion thereof located in the passage 123 for supplying the plating solution comprising the warps alone.

* * * * *